US009566801B2

(12) United States Patent
Oida et al.

(10) Patent No.: US 9,566,801 B2
(45) Date of Patent: Feb. 14, 2017

(54) TAPE PRINTER

(71) Applicant: Seiko Epson Corporation, Tokyo (JP)

(72) Inventors: Masahiro Oida, Suwa (JP); Junpei Watanabe, Chiyoda-ku (JP); Ayako Inoue, Chiyoda-ku (JP); Tomoko Yamada, Chiyoda-ku (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 14/808,812

(22) Filed: Jul. 24, 2015

(65) Prior Publication Data

US 2016/0039220 A1 Feb. 11, 2016

(30) Foreign Application Priority Data

Aug. 5, 2014 (JP) ..... 2014-159231

(51) Int. Cl.
*B41J 3/36* (2006.01)
*B41J 3/407* (2006.01)

(52) U.S. Cl.
CPC ..... *B41J 3/4075* (2013.01); *B41J 3/36* (2013.01)

(58) Field of Classification Search
CPC ..... B41J 3/36; B41J 3/4075; G06F 3/04842; G06F 3/1242
See application file for complete search history.

(56) References Cited

U.S. PATENT DOCUMENTS

2009/0249200 A1* 10/2009 Hasegawa ..... H04N 1/32117 715/273
2010/0027070 A1* 2/2010 Vleurinck ..... B41J 3/4075 358/1.16
2012/0195517 A1* 8/2012 Mittur ..... G06F 21/31 382/254

FOREIGN PATENT DOCUMENTS

| | | |
|---|---|---|
| JP | H6-348706 A | 12/1994 |
| JP | H11-234506 A | 8/1999 |
| JP | 2006-140849 | 6/2006 |
| JP | 2008-048459 | 2/2008 |
| JP | 2009-105674 A | 5/2009 |

* cited by examiner

*Primary Examiner* — Kristal Feggins
*Assistant Examiner* — Kendrick Liu
(74) *Attorney, Agent, or Firm* — ALG Intellectual Property, LLC

(57) ABSTRACT

Disclosed is a tape printer including: a vertical/horizontal conversion section that applies vertical/horizontal conversion processing to a character image to be rotated in at least one of a clockwise direction and a counterclockwise direction; a print section that prints the character image on a tape; a time acquisition section that acquires time displayed by a hand image constituting a hand type clock image serving as the character image; and a basic hand image storage section that stores a main basic hand image of a plurality of the hand images whose angles are different from each other according to time, wherein, when the hand image that displays the time acquired by the time acquisition section is not included in the basic hand image, the vertical/horizontal conversion section applies the vertical/horizontal conversion processing to the basic hand image to generate the hand image that displays the time acquired by the time acquisition section.

5 Claims, 12 Drawing Sheets

FIG. 6

| HAND ANGLE | BASIC HAND IMAGE OF SHORT HAND | | BASIC HAND IMAGE OF LONG HAND | |
|---|---|---|---|---|
| | STRAIGHT LINE | ARROW | STRAIGHT LINE | ARROW |
| 0° | | | | |
| 6° | | | | |
| 12° | | | | |
| 18° | | | | |
| 24° | | | | |
| 30° | | | | |
| 36° | | | | |
| 42° | | | | |
| 48° | | | | |
| 54° | | | | |
| 60° | | | | |
| 66° | | | | |
| 72° | | | | |
| 78° | | | | |
| 84° | | | | |

FIG. 7

| No | FACE IMAGE | HAND POSITION | HAND COLOR | CORRESPONDING SHORT HAND/LONG HAND DESIGH |
|---|---|---|---|---|
| 01 | 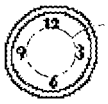 F | MIDDLE TYPE | DISPLAY TYPE | STRAIGHT LINE |
| 02 | 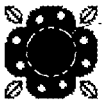 F | MIDDLE TYPE | REVERSED DISPLAY TYPE | STRAIGHT LINE |
| 03 | 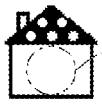 F | LOW TYPE | DISPLAY TYPE | ARROW |
| 04 | 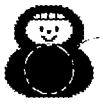 F | LOW TYPE | REVERSED DISPLAY TYPE | ARROW |
| 05 | 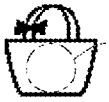 F | LOW TYPE | DISPLAY TYPE | ARROW |
| 06 | 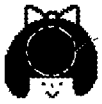 F | MIDDLE TYPE | REVERSED DISPLAY TYPE | STRAIGHT LINE |
| 07 | 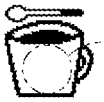 F | LOW TYPE | DISPLAY TYPE | STRAIGHT LINE |
| 08 | 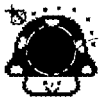 F | MIDDLE TYPE | REVERSED DISPLAY TYPE | STRAIGHT LINE |
| 09 | 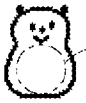 F | LOW TYPE | DISPLAY TYPE | STRAIGHT LINE |
| 10 | 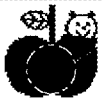 F | LOW TYPE | REVERSED DISPLAY TYPE | ARROW |

DESIGN
G
[←] or [→]

DESIGN
G
[SELECT]

TIME
00 : 00
H
[↑]

TIME
03 : 00
H
[SELECT] or [←] or [→]

TIME
03 : 00
H
[SELECT]

PRINT
ONE SHEET
[SELECT]

NOW PREPARING

NOW PRINTING
1/1 SHEET

C
Bb1
Bb2

B1
B2

Bc

A

TAPE PRINTER

CROSS REFERENCES TO RELATED APPLICATIONS

The entire disclosure of Japanese Patent Application No. 2014-159231, filed Aug. 5, 2014 is expressly incorporated by reference herein.

BACKGROUND

1. Technical Field

The present invention relates to a tape printer that prints character images on a tape.

2. Related Art

Conventionally, as a face image creator that creates face images, there has been known one in which a parts screen ROM stores only the parts pattern of a left eye among the parts pattern of the left eye and the parts pattern of a right eye and reverses the parts pattern of the left eye to create the parts pattern of the right eye. Thus, the face image creator reduces the storage capacity of the parts screen ROM by half (see JP-A-6-348706).

The present inventor has found the following problem. When a tape printer prints a hand type (analog type) clock image on a tape, it is assumed that a storage section stores only basic hand images that represent some of a plurality of hand images whose angles are different from each other according to time in order to reduce the storage capacity thereof. In this case, the tape printer is assumed to perform image processing to rotate the stored basic hand images to create the rest hand images. However, a dedicated image processing section to perform the rotation processing of the hand images results in a high product cost. Therefore, there is demand for reducing the storage capacity of the hand image storage section without the dedicated image processing section to perform the rotation processing of the hand images.

An advantage of an aspect of the present invention is to provide a tape printer capable of reducing the storage capacity of a hand image storage section without a dedicated image processing section to perform the rotation processing of hand images.

SUMMARY

According to an aspect of the present invention, there is provided a tape printer including: a vertical/horizontal conversion section that performs vertical/horizontal conversion processing to rotate a character image in at least one of a clockwise direction and a counterclockwise direction such that a direction of the character image printed on a tape is switched between a horizontal writing direction in which a vertical direction of the character image is parallel to a width direction of the tape and a vertical writing direction in which the vertical direction of the character image is parallel to a longitudinal direction of the tape; a print section that prints the character image on the tape; a time acquisition section that acquires time displayed by a hand image constituting a hand type clock image serving as the character image; and a basic hand image storage section that stores a main basic hand image of a plurality of the hand images whose angles are different from each other according to time, wherein, when the hand image that displays the time acquired by the time acquisition section is not included in the basic hand image, the vertical/horizontal conversion section performs the vertical/horizontal conversion processing on the basic hand image to generate the hand image that displays the time acquired by the time acquisition section.

According to the configuration, the tape printer stores the basic hand image of the plurality of hand images whose angles are different from each other in the hand image storage section. Further, the tape printer rotates the basic hand image with the vertical/horizontal conversion section used to switch the vertical direction of the character image between the horizontal writing direction and the vertical writing direction. In this way, the tape printer may generate the hand image whose angle is different from that of the basic hand image. Accordingly, the tape printer may reduce the storage capacity of the hand image storage section without a dedicated image processing section to perform the rotation processing of the hand images.

In this case, the tape printer preferably further includes: a face image storage section that stores a plurality of face images, one of which constitutes the hand type clock image; a face image selection section that selects one of the face images to be printed with the hand image; and an image combination section that combines the selected face image and the hand image with each other to generate the hand type clock image.

According to the configuration, the tape printer may print the hand type clock image, in which the face image selected from among the stored face images and the hand image are combined with each other, on the tape.

In this case, the hand image storage section preferably stores one of the basic hand image whose hand is represented by display dots and the basic hand image whose hand is represented by reversed display dots obtained by reversing the display dots, the face image storage section preferably stores the face images in which a rotation range of the hand is represented by display dots and the face images in which a rotation range of the hand is represented by reversed display dots, and the image combination section preferably combines the face image and the hand image with each other such that the hand of the hand type clock image is represented by the reversed display dots when the rotation range of the hand of the selected face image is represented by the display dots, and combines the face image and the hand image with each other such that the hand of the hand type clock image is represented by the display dots when the rotation range of the hand of the selected face image is represented by the reversed display dots.

According to the configuration, the tape printer stores only one of the basic hand image whose hand is represented by the display dots and the basic hand image whose hand is represented by the reversed display dots in the hand image storage section. Further, the tape printer may print the analog type clock image in which the hand is represented by the reversed display dots and the analog type clock image in which the hand is represented by the display dots based on whether the rotation range of the hand of the selected face image is represented by the display dots or the reversed display dots. Accordingly, the tape printer may increase the variation of the combination between the color of the hand and the color of the rotation range of the hand while reducing the storage capacity of the hand image storage section.

In this case, the hand image storage section preferably stores the basic hand image in which a rotation center of the hand is provided at a prescribed position, the face image storage section preferably stores the face images in which a rotation range of the hand is set at the prescribed position and the face images in which a rotation range of the hand is set at a position shifted from the prescribed position, and the image combination section preferably shifts the hand image and combines the face image and the shifted hand image with each other when the rotation range of the selected face image is set at a position shifted from a position corresponding to the prescribed position.

According to the configuration, the tape printer stores only the basic hand image in which the rotation center of the hand is set at the prescribed position in the hand image storage section. Further, the tape printer may print the hand type clock image in which the rotation center of the hand is set at the prescribed position and the hand type clock image in which the rotation center of the hand is set at the position shifted from the prescribed position depending on whether the rotation range of the hand of the selected face image is provided at the prescribed position or the shifted position. Accordingly, the tape printer may increase the variation of the rotation center of the hand and the position of the rotation range of the hand while reducing the storage capacity of the hand image storage section.

In this case, the plurality of face images stored in the face image storage section preferably includes the face images representing action plans of a user.

According to the configuration, the tape printer may print the analog type clock image that represents both the action plans of the user and the time of the action plans. Thus, the user may recognize both his/her action plans and the time of the action plans.

BRIEF DESCRIPTION OF THE DRAWINGS

FIG. 6 is a diagram for describing basic hand images stored in a hand image storage section.

FIG. 7 is a diagram for describing face images stored in a face image storage section.

DESCRIPTION OF EXEMPLARY EMBODIMENTS

Hereinafter, a description will be given, with reference to the accompanying drawings, of a tape printer according to an embodiment of the present invention.

Figure 1:
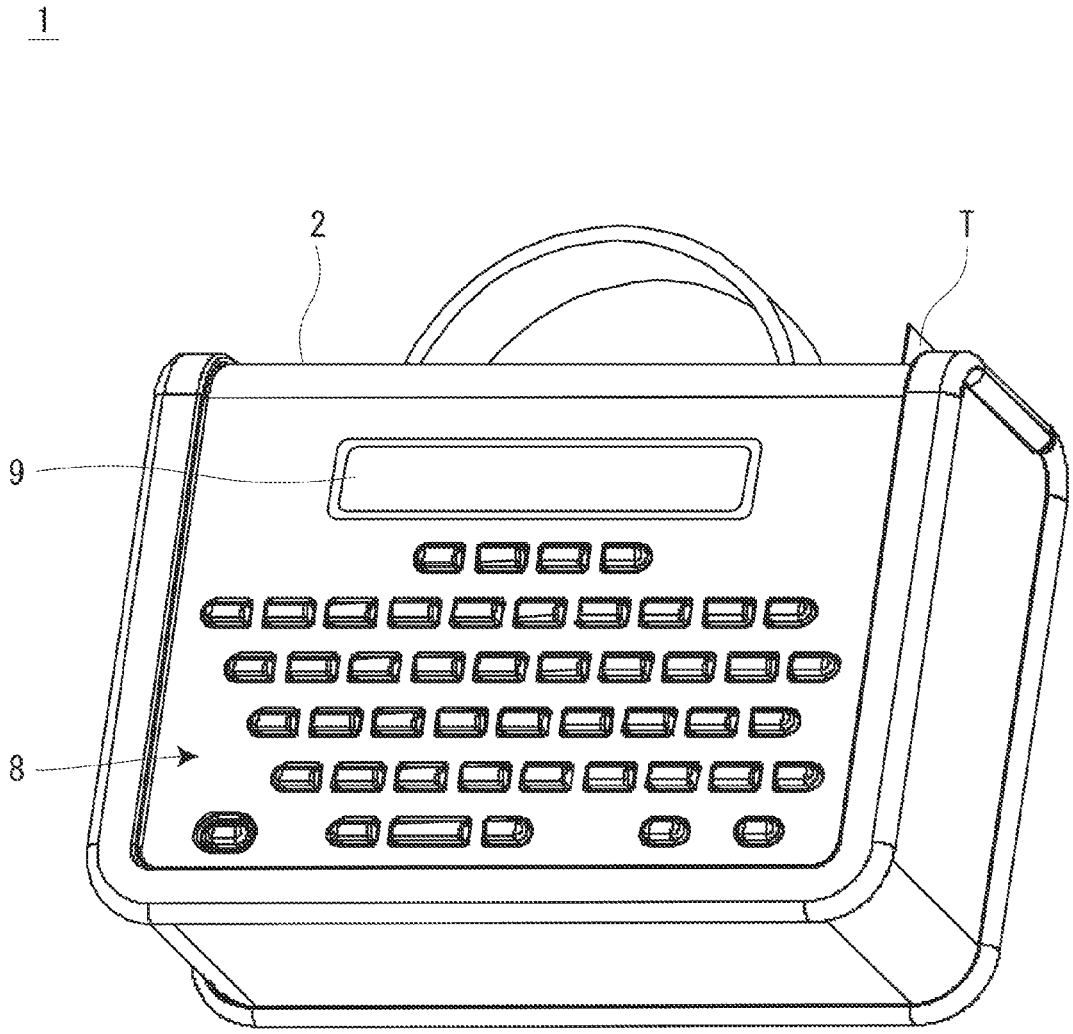
FIG. 1 is a perspective view of a tape printer according to an embodiment of the present invention when seen from its front side.
Figure 2:
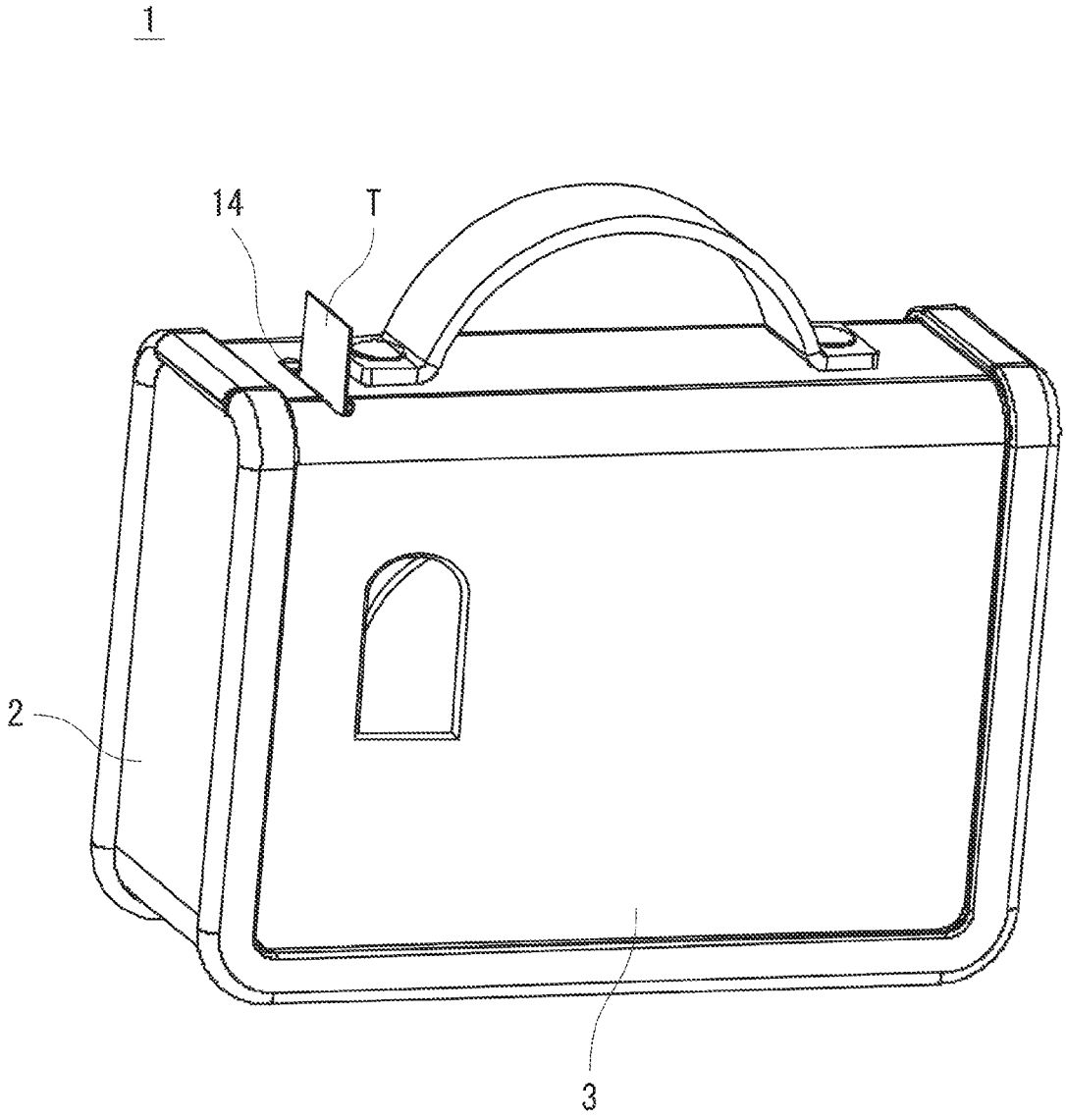
FIG. 2 is a perspective view of the tape printer when seen from its back side.
Figure 3:
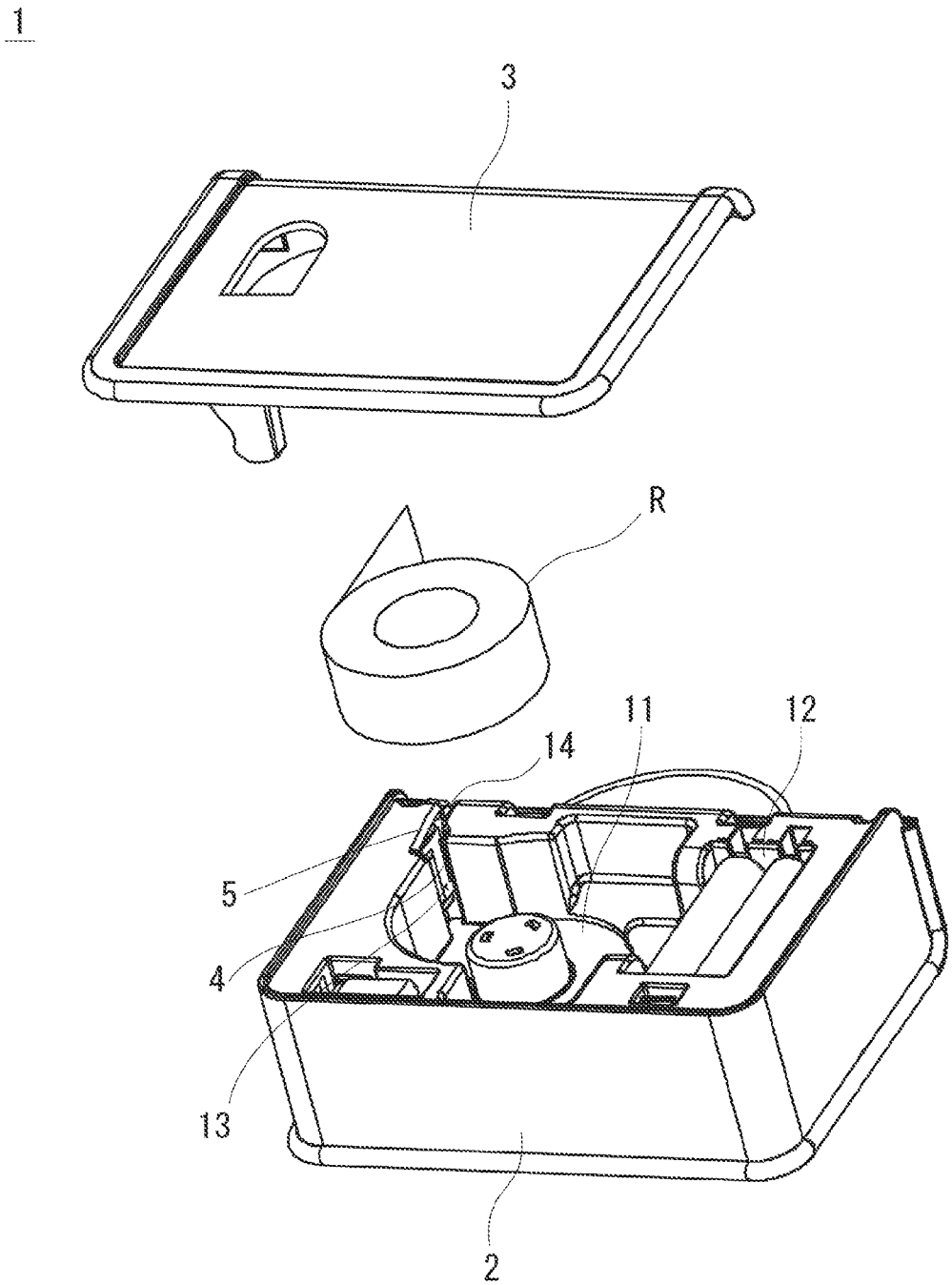
FIG. 3 is a perspective view of the tape printer with its cover body removed.

As shown in FIGS. 1 to 3, a tape printer 1 has a printer case 2, a cover body 3, a platen roller 4, and a print head 5.

The printer case 2 forms the outer shell of the tape printer 1. The printer case 2 has a keyboard 8 and a display 9 on its front side. The keyboard 8 accepts an input operation from a user. The keyboard 8 has character keys to input characters and symbols, cursor keys to move a cursor and switch an alternative, a selection key to determine an alternative, a print key to perform printing, a vertical/horizontal key to switch a direction of character images D (see FIGS. 4A and 4B) between a horizontal writing direction (i.e., landscape) and a vertical writing direction (i.e., portrait), or the like. The display 9 displays a result or the like input with the keyboard 8. The user inputs characters, symbols, or the like as desired print targets with the keyboard 8 while confirming an input result on the display 9.

The printer case 2 has a roll installation portion 11, a battery accommodation portion 12, and a feed path 13 on its back side. In addition, the printer case 2 has a tape ejection port 14 on its lateral side.

In the roll installation portion 11, a small-wound tape roll R is installed. The tape roll R is constituted by a long tape T wound up in a roll shape so as to form a hole with a prescribed size at its axis. The tape T has a tape main body and a separation tape. The tape main body is constituted by a thermal paper. The tape T is so-called a masking tape and includes a plurality of types in which the front surfaces of the tape main bodies are different in color and design.

The feed path 13 is provided between the roll installation portion 11 and the tape ejection port 14. The tape T fed out from the roll installation portion 11 is ejected from the tape ejection port 14 to the outside of the tape printer 1 via the feed path 13. Note that the user cuts off a printed part of the tape T ejected from the tape ejection port 14 with scissors or the like. The tape printer 1 may, of course, has a cutter to cut off the tape T.

The cover body 3 is provided on the back side of the printer case 2. The cover body 3 covers the roll installation portion 11, the battery accommodation portion 12, and the feed path 13. The user opens/closes the cover body 3 at the installation of the tape roll R, the replacement of batteries, or the like.

The platen roller 4 rotates with a feed motor 15 as a drive source. The platen roller 4 feeds the tape T held between the platen roller 4 and the print head 5 by rotation. The print head 5 prints the character images D on the tape T. The print head 5 is provided so as to face the platen roller 4 across the feed path 13. The print head 5 is of a thermal type. The print head 5 is heated and driven to print the character images D on the tape T fed along the feed path 13. The character images D are expressed in the form of a bitmap font. Note that the character images D refer to images of characters such as texts, symbols, graphics, and pictograms and represent a concept including a hand type (analog type) clock image A (see FIG. 12E) that will be described later. Note that a hand type clock will be called an analog type clock in the following description.

The analog type clock image A includes a short hand (i.e., hour hand) image B1 as an image of the short hand of an analog type clock, a long hand (i.e., minute hand) image B2 as an image of the long hand thereof, and a face image C as an image of the face (clock frame) thereof (see FIGS. 12A to 12E). As will be described in detail later, the tape printer 1 prints the short hand image B1 and the long hand image B2 that represent time input by the user based on a clock image print menu. According to the input time, the tape printer 1 is capable of printing 60 types of the short hand images B1 whose angles are different from each other by six degrees and 60 types of the long hand images B2 whose angles are different from each other by six degrees.

Figure 4A:
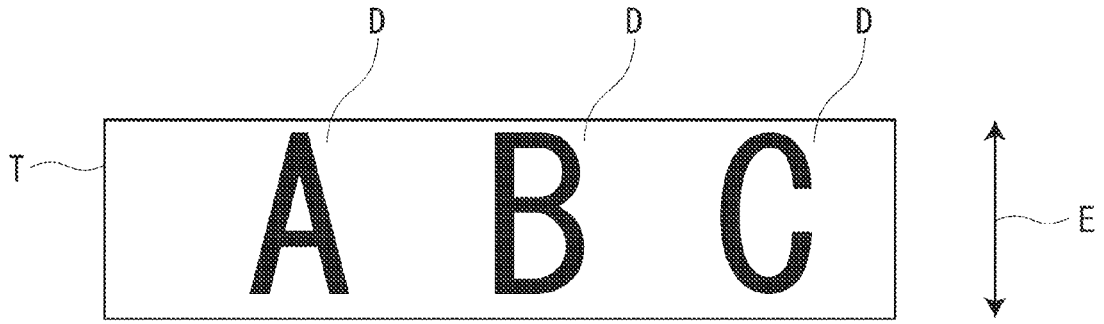
FIG. 4A is a view showing the horizontal writing direction of character images.
Figure 4B:
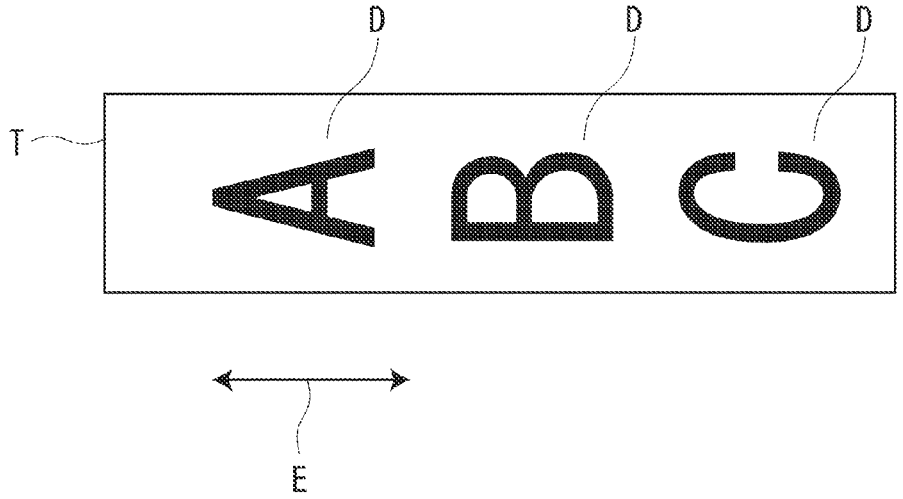
FIG. 4B is a view showing the vertical writing direction of the character images.

As shown in FIGS. 4A and 4B, the tape printer 1 switches a direction of the character images D between the horizontal writing direction and the vertical writing direction every time the user presses the vertical/horizontal key. The horizontal writing direction represents a direction in which a vertical direction E of the character images D is parallel to the width direction of the tape T as shown in FIG. 4A. The vertical writing direction represents a direction in which the vertical direction E of the character images D is parallel to the longitudinal direction of the tape T as shown in FIG. 4B.

The tape printer 1 stores the character images D so as to be set in the horizontal writing direction. Then, when the user presses the vertical/horizontal key in a state in which the character images D are set in the horizontal writing direction, the tape printer 1 performs vertical/horizontal conversion processing to rotate the character images D counterclockwise by 90 degrees to set the same in the vertical writing direction. On the other hand, when the user presses the vertical/horizontal key in a state in which the character images D are set in the vertical writing direction, the tape printer 1 cancels the vertical/horizontal conversion processing to restore the character images D to the state of the horizontal writing direction. Note that in the clock image print menu, the tape printer 1 performs the vertical/horizontal conversion processing regardless of the vertical/horizontal key as will be described in detail later.

Figure 5A:
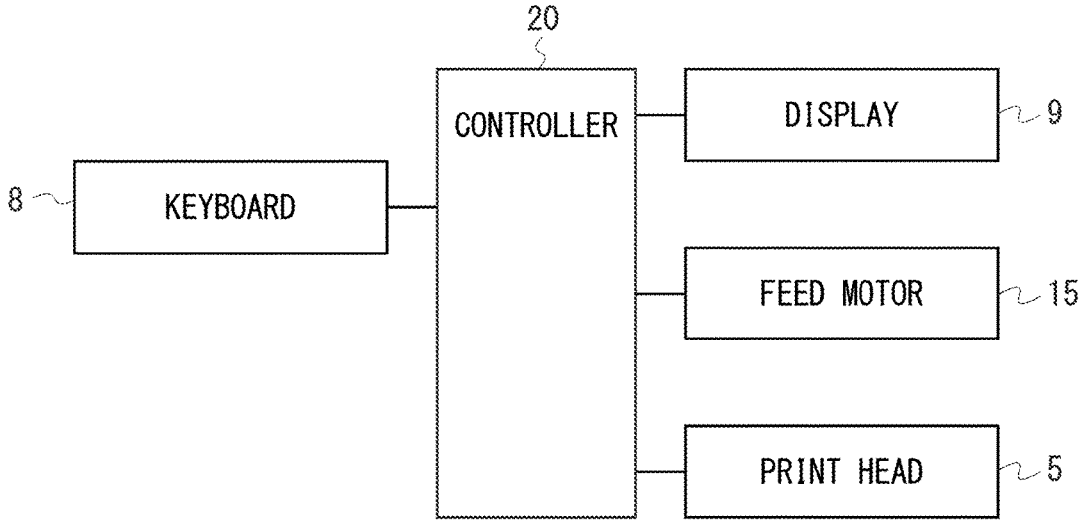
FIG. 5A is a diagram showing a hardware configuration example of the tape printer.

A description will be given of a hardware configuration example of the tape printer 1 with reference to FIG. 5A. The tape printer 1 has a controller 20, besides the print head 5, the keyboard 8, the display 9, and the feed motor 15 described above.

The controller 20 is constituted by a CPU (Central Processing Unit), a ROM (Read Only Memory), a RAM (Random Access Memory), or the like not shown. The CPU of the controller 20 loads a program from the ROM and performs the same with the RAM to control the entire operation of the tape printer 1.

Figure 5B:
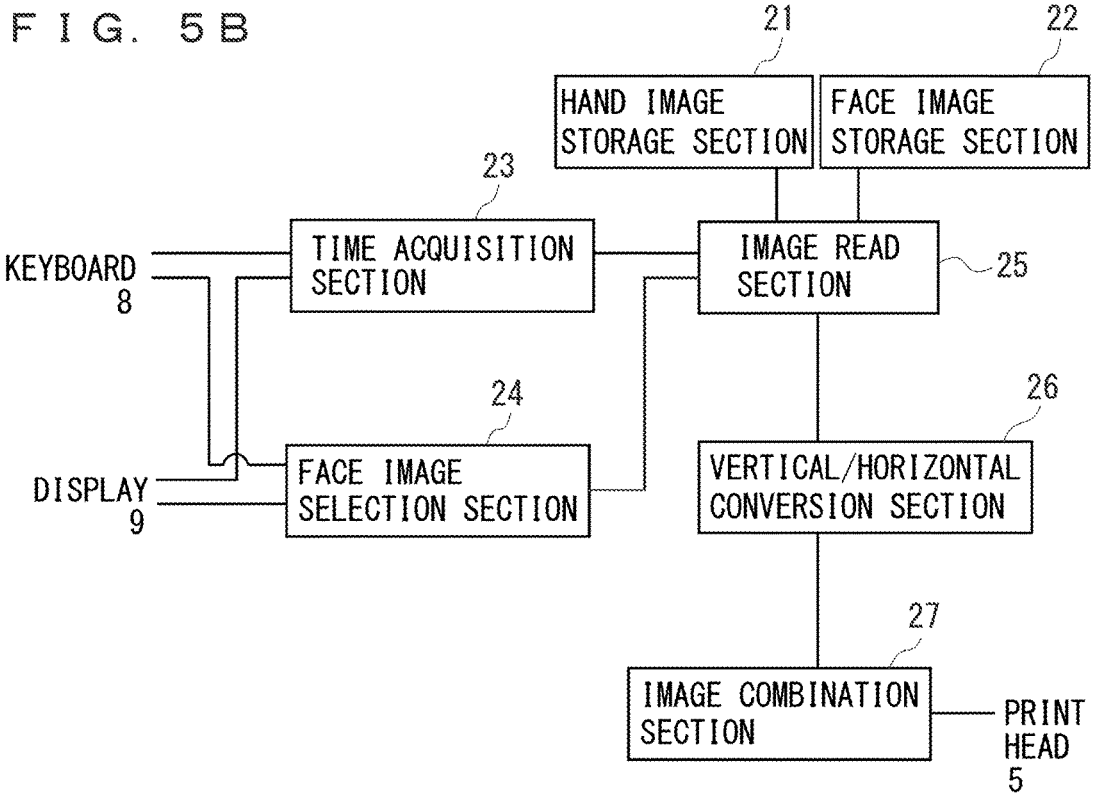
FIG. 5B is a diagram showing a function configuration example of the tape printer.
Figures 8A, 8B, 8C, 8D:
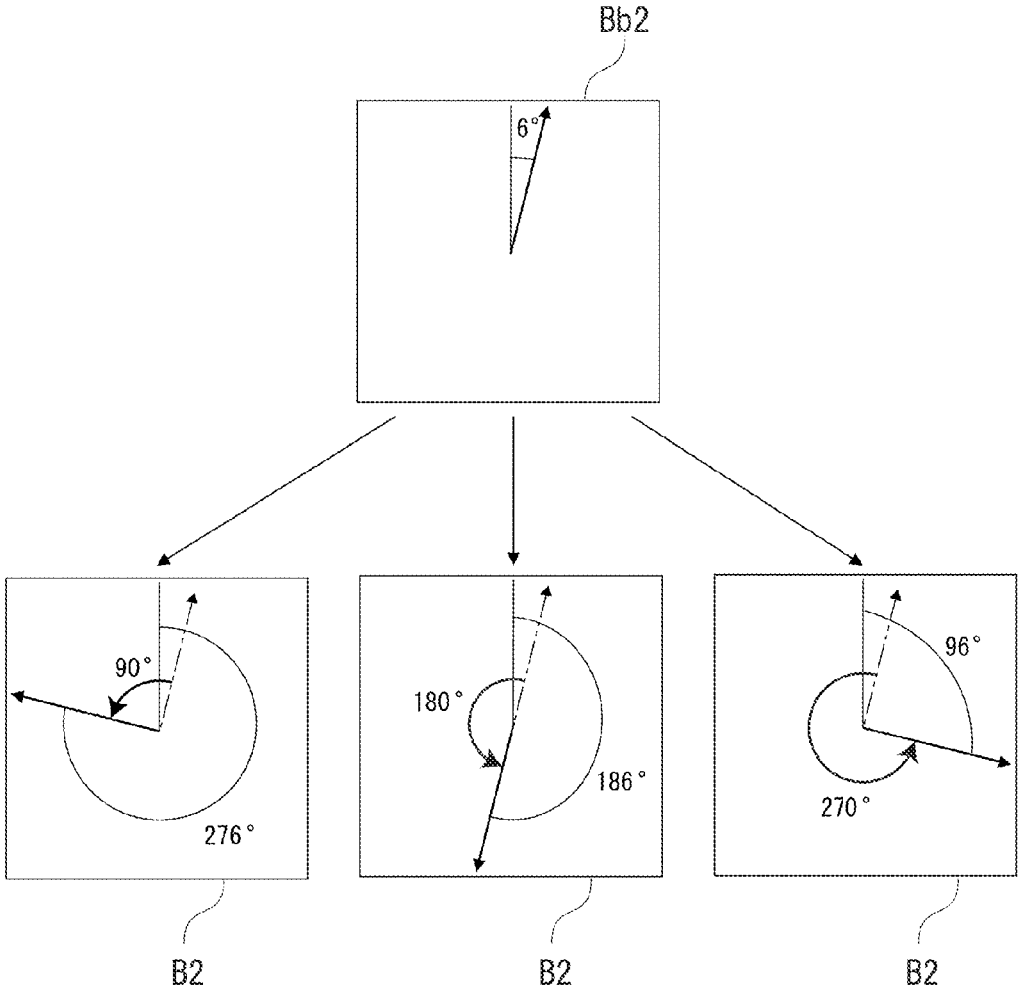
FIGS. 8A to 8D are diagrams for describing the rotation of the basic hand images with vertical/horizontal conversion processing.

A description will be given of a function configuration example of the tape printer 1 with reference to FIG. 5B. At least some of function sections shown in FIG. 5B are implemented when the controller 20 shown in FIG. 5A performs a prescribed program.

The tape printer 1 has a hand image storage section 21, a face image storage section 22, a time acquisition section 23, a face image selection section 24, an image read section 25, a vertical/horizontal conversion section 26, and an image combination section 27.

As shown in FIG. 6, the hand image storage section 21 stores 15 types of basic short hand images Bb1 whose hand angles are between zero and 84 degrees among the 60 types of the short hand image B1 whose angles are different from each other as described above. That is, the hand image storage section 21 stores the 15 types of the basic short hand images Bb1 to display time between 0:00 and 2:59. In addition, the hand image storage section 21 stores 15 types of basic long hand images Bb2 whose hand angles are between zero and 84 degrees among the 60 types of the long hand images B2 whose angles are different from each other. That is, the hand image storage section 21 stores the 15 types of the basic long hand images Bb2 to display time between zero and 14 minutes. The basic short hand images Bb1 and the basic long hand images Bb2 will be simply called basic hand images Bb when they are not required to be distinguished from each other. Note that the hand angles represent angles formed clockwise when the position of 00:00 is set at zero degree.

In each of the basic hand images Bb stored in the hand image storage section 21, the hand is represented by display dots and a part other than the hand is represented by reversed display dots. In addition, in each of the basic hand images Bb stored in the hand image storage section 21, the rotation center of the hand is provided at the center of the face image C. The font size of the basic hand images Bb is, for example, 48×48 dots. Note that the hand image storage section 21 stores two types of designs, i.e., a "straight line" and an "arrow" for the respective hand angles. That is, the hand image storage section 21 stores 30 (15×2) types of the basic short hand images Bb1 and 30 (15×2) types of the basic long hand images Bb1.

As shown in FIG. 7, the face image storage section 22 stores ten types of the face images C. The ten types of the face images C include the face image C of "shopping" that appears in No. 5 and the face image C of "tea time" that appears in No. 7, each of which indicates the action plan of the user. The font size of the face images C is equal to that of the basic hand images Bb and is, for example, 48×48 dots.

The face image storage section 22 stores the respective face images C in association with hand colors. That is, for the face images C (that appear in No. 1, 3, 5, 7, and 9) in which the rotation range F (see FIGS. 12A to 12E) of the hands is represented by reversed display dots, the face image storage section 22 stores the color of the hands as a "display type." In addition, for the face images C (that appear in No. 2, 4, 6, 8, and 10) in which the rotation range F of the hands is represented by display dots, the face image storage section 22 stores the color of the hands as a "reversed display type."

The face image storage section 22 stores the respective face images C in association with hand positions. That is, for the face images C (that appear in No. 1, 2, 6, and 8) in which the rotation range F of the hands is provided at their central position, i.e., position corresponding to the position at which the rotation center of the hands of the basic hand images Bb is provided, the face image storage section 22 stores the position of the hands as a "middle type." In addition, for the face images C (that appear in No. 3, 4, 5, 7, 9, and 10) in which the rotation range F of the hands is provided at a position shifted by a prescribed distance (for example, nine dots) from the central position to a lower position, the face image storage section 22 stores the position of the hands as a "low type." Note that FIG. 7 virtually shows the rotation ranges F of the hands of the respective face images C with two-dot chain lines.

Moreover, the face image storage section 22 stores the respective face images C in association with hand designs. That is, for the face images C (that appear in No. 1, 2, 6, 7, 8, and 9), the face image storage section 22 stores the design of the hands as a "straight line." For the face images C (that appear in No. 3, 4, 5, and 10), the face image storage section 22 stores the design of the hands as an "arrow."

The time acquisition section 23 displays a time input screen H to cause the user to input time, which is displayed by the short hand image B1 and the long hand image B2, on the display 9. On the time input screen H, the time acquisition section 23 acquires the time displayed by the short hand image B1 and the long hand image B2 based on the input operation of the time acquired via the keyboard 8. Note that on the time input screen H, the time is input according to a 12-hour display mode regardless of morning and afternoon hours.

The face image selection section 24 displays a face image selection screen G to cause the user to select the face image C on the display 9. The face image selection section 24 selects the face image C based on the selective operation of the face image C accepted via the keyboard 8 on the face image selection screen G.

The image read section 25 reads the face image C selected by the face image selection section 24 among the 10 types of the face images C stored in the face image storage section 22.

In addition, the image read section 25 reads the basic hand images Bb, each of which has a hand angle corresponding to the time acquired by the time acquisition section 23 and has the design associated with the selected face image C, from among the basic hand images Bb stored in the hand image storage section 21. Here, as described above, the hand image storage section 21 stores only the basic long hand images Bb2 of the 15 types of the hand angles among the 60 types of the printable long hand images B2. Therefore, when the long hand image B2 that displays the acquired time is included in the basic long hand images Bb2, the image read section 25 reads the basic long hand image Bb2 that displays the acquired time. On the other hand, when the long hand image B2 that displays the acquired time is not included in the basic long hand images Bb2, the image read section 25 reads the basic long hand image Bb2 that may be turned into the long hand image B2 that displays the acquired time after being rotated by 90, 180, or 270 degrees by the vertical/horizontal conversion processing. For example, when the minute of the acquired time points at not only one minute but 16 minutes, 31 minutes, and 46 minutes, the image read section 25 reads the basic long hand image Bb2 that has a hand angle of six degrees (see FIGS. 8A to 8D). The same applies to the short hand images B1.

In other words, when the acquired time points at h o'clock and m minute, the image read section 25 reads the basic short hand image Bb1 that has a hand angle of p degree(s). Here, p is given according to Formula 1.

$$p=6\times a \quad \text{(Formula 1)}$$

Note that a is the quotient obtained by dividing c by 12 when the remainder obtained by dividing $(60\mp h)+m$ by 180 is c (a is an integer). In addition, when the acquired time points at h o'clock and m minute, the image read section 25 reads the basic long hand image Bb2 that has a hand angle of q degree(s). Here, q is given according to Formula 2.

$$q=6\times b \quad \text{(Formula 2)}$$

Note that b is the remainder obtained by dividing m by 15.

When the long hand image B2 that displays the acquired time is not included in the basic long hand images Bb2, the vertical/horizontal conversion section 26 applies the vertical/horizontal conversion processing to the basic long hand image Bb2 once to three times to rotate the same counterclockwise by 90, 180, or 270 degrees. Thus, the tape printer 1 is capable of generating the long hand images B2 of the 60 types of the hand angles in total. That is, the tape printer 1 is capable of generating the long hand images B2 of the 15 types of the hand angles (270 to 354 degrees) by rotating each of the basic long hand images Bb2 of the 15 types of the hand angles counterclockwise by 90 degrees. In addition, the tape printer 1 is capable of generating the long hand images B2 of the 15 types of the hand angles (180 to 264 degrees) by rotating each of the basic long hand images Bb2 of the 15 types of the hand angles counterclockwise by 180 degrees. Moreover, the tape printer 1 is capable of generating the long hand images B2 of the 15 types of the hand angles (90 to 174 degrees) by rotating each of the basic long hand images Bb2 of the 15 types of the hand angles counterclockwise by 270 degrees. The same applies to the short hand images B1.

A description will be given in further detail of the processing of the vertical/horizontal conversion section 26. For example, when the minute of the acquired time points at 46 minutes, the vertical/horizontal conversion section 26 applies the vertical/horizontal conversion processing to the basic long hand image Bb2 (see FIG. 8A), which displays one minute at a hand angle of six degrees, once to rotate the same counterclockwise by 90 degrees to generate the long hand image B2 (see FIG. 8B) that displays 46 minutes at a hand angle of 276 degrees. In addition, when the minute of the acquired time points at 31 minutes, the vertical/horizontal conversion section 26 applies the vertical/horizontal conversion processing to the basic long hand image Bb2, which displays one minute at a hand angle of six degrees, twice to rotate the same counterclockwise by 180 degrees to generate the long hand image B2 (see FIG. 8C) that displays 31 minutes at a hand angle of 186 degrees.

Moreover, when the minute of the acquired time points at 16 minutes, the vertical/horizontal conversion section 26 applies the vertical/horizontal conversion processing to the basic long hand image Bb2, which displays one minute at a hand angle of six degrees, three times to rotate the same counterclockwise by 270 degrees to generate the long hand image B2 (see FIG. 8D) that displays 16 minutes at a hand angle of 96 degrees.

The vertical/horizontal conversion section 26 determines whether there is need to apply the vertical/horizontal conversion processing to the basic hand images Bb based on the acquired time. When the acquired time is between 00:00 and 02:59, the vertical/horizontal conversion section 26 determines that there is no need to apply the vertical/horizontal conversion processing to the basic short hand images Bb1. On the other hand, when the acquired time is between 03:00 and 11:59, the vertical/horizontal conversion section 26 determines that there is need to apply the vertical/horizontal conversion processing to the basic short hand images Bb1. Further, the vertical/horizontal conversion section 26 applies the vertical/horizontal conversion processing to the basic short hand images Bb1 three times when the acquired time is between 03:00 and 5:59, applies the vertical/horizontal conversion processing to the basic short hand images Bb1 twice when the acquired time is between 06:00 and 08:59, and applies the vertical/horizontal conversion processing to the basic short hand images Bb1 once when the acquired time is between 09:00 and 11:59.

Similarly, when the minute of the acquired time is between zero and 14 minutes, the vertical/horizontal conversion section 26 determines that there is no need to apply the vertical/horizontal conversion processing to the basic long hand images Bb2. On the other hand, when the minute of the acquired time is between 15 and 59 minutes, the vertical/horizontal conversion section 26 determines that there is need to apply the vertical/horizontal conversion processing to the basic long hand images Bb2. Further, the vertical/horizontal conversion section 26 applies the vertical/horizontal conversion processing to the basic long hand images Bb2 three times when the minute of the acquired time is between 15 and 29 minutes, applies the vertical/horizontal conversion processing to the basic long hand images Bb2 twice when the minute of the acquired time is between 30 and 44 minutes, and applies the vertical/horizontal conversion processing to the basic long hand images Bb2 once when the minute of the acquired time is between 45 and 59 minutes.

The image combination section 27 combines the short hand image B1, the long hand image B2, and the face image C with each other to generate the analog type clock image A. A specific procedure for combining the images with each other will be described later.

Figure 9:
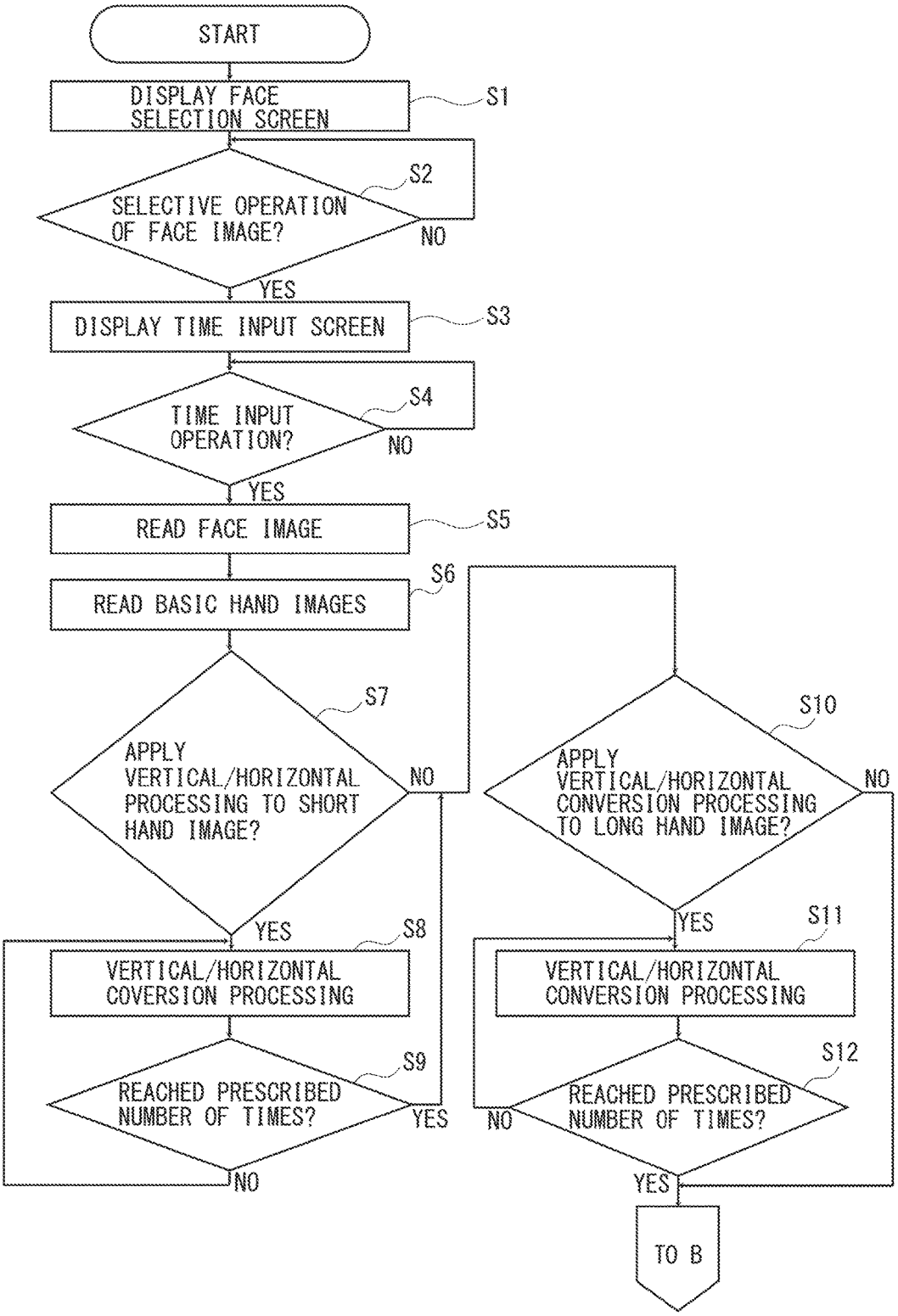
FIG. 9 is a flowchart showing a series of processing in the clock image print menu of the tape printer.
Figure 10:
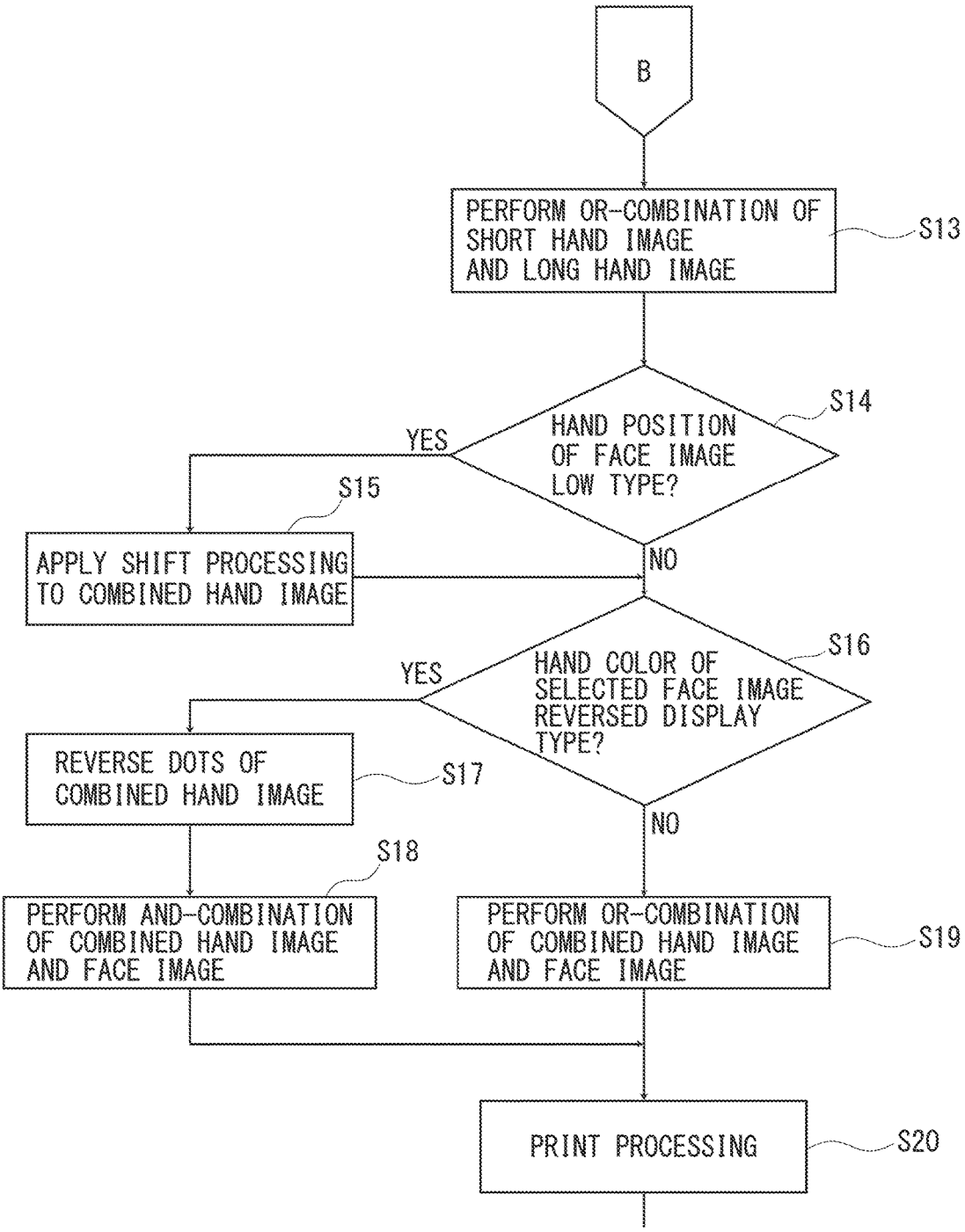
FIG. 10 is a flowchart following FIG. 9.

A description will be given, with reference to FIG. 5 and by the use of FIGS. 9 and 10, of a series of processing performed by the tape printer 1 according to the clock image print menu. When the clock image print menu starts, the face image selection section 24 first displays the face image selection screen G (see FIGS. 11A and 11B) on the display 9 (S1). When the user performs the selective operation of the face image C on the face image selection screen G via the keyboard 8 (S2; Yes), the face image selection section 24 selects the face image C based on the selective operation.

Next, the time acquisition section 23 displays the time input screen H on the display 9 (S3). When the user performs time input operation on the time input screen H via the keyboard 8 (S3; Yes), the time acquisition section 23 acquires time displayed by the short hand image B1 and the long hand image B2 based on the input operation.

Then, the image read section 25 reads the selected face image C from the face image storage section 22 (S5). Next, the image read section 25 reads the basic short hand image Bb1 and the basic long hand image Bb1, each of which corresponds to the acquired time and has the design associated with the selected face image C, from the hand image storage section 21 (S6).

Next, the vertical/horizontal conversion section 26 determines whether there is need to apply the vertical/horizontal conversion processing to the basic short hand image Bb1 based on the acquired time (S7). When it is determined that there is need to apply the vertical/horizontal conversion processing to the basic short hand image Bb1 (S7; Yes), the vertical/horizontal conversion section 26 applies the vertical/horizontal conversion processing to the basic short hand image Bb1 (S8). When the number of the application times of the vertical/horizontal conversion processing has not reached the prescribed number of times (S9; No), the vertical/horizontal conversion section 26 applies the vertical/horizontal conversion processing to the basic short hand image Bb1 again (S8). When the number of the application times of the vertical/horizontal conversion processing has reached the prescribed number of times (S9; Yes), the processing proceeds to step 10. On the other hand, when it is determined that there is no need to apply the vertical/horizontal conversion processing to the basic short hand image Bb1 (S7; No), the processing proceeds to step 10. Thus, when the vertical/horizontal conversion section 26 applies the vertical/horizontal conversion processing to the basic short hand image Bb1 as occasion demands, the short hand image B1 that displays the acquired time is obtained.

In step 10, the vertical/horizontal conversion section 26 determines whether there is need to apply the vertical/horizontal conversion processing to the basic long hand image Bb2 based on the minute of the acquired time. When it is determined that there is need to apply the vertical/horizontal conversion processing to the basic long hand image Bb2 (S10; Yes), the vertical/horizontal conversion section 26 applies the vertical/horizontal conversion processing to the basic long hand image Bb2 (S11). When the number of the application times of the vertical/horizontal conversion processing has not reached the prescribed number of times (S12; No), the vertical/horizontal conversion section 26 applies the vertical/horizontal conversion processing to the basic long hand image Bb2 again (S11). When the number of the application times of the vertical/horizontal conversion processing has reached the prescribed number of times (S12; Yes), the processing proceeds to step 13. On the other hand, when it is determined that there is no need to apply the vertical/horizontal conversion processing to the basic long hand image Bb2 (S10; No), the processing proceeds to step 13. Thus, when the vertical/horizontal conversion section 26 applies the vertical/horizontal conversion processing to the basic long hand image Bb2 as occasion demands, the long hand image B2 that displays the acquired time is obtained.

In step 13, the image combination section 27 performs the OR-combination (calculates OR) of the short hand image B1 and the long hand image B2, each of which displays the acquired time, with each other to generate a combined hand image Bc. Then, the image combination section 27 determines whether the hand position of the selected face image C is the "low type" (S14). When it is determined that the hand position of the selected face image C is the "low type" (S14; Yes), the image combination section 27 applies shift processing to the combined hand image Bc (S15). In the shift processing, the vertical/horizontal conversion section 26 shifts the combined hand image Bc downward by a prescribed distance (for example, nine dots). After the image combination section 27 applies the shift processing to the combined hand image Bc, the processing proceeds to step 16. On the other hand, when it is determined by the image combination section 27 that the hand position of the selected face image C is not the "low type" (S14; No), the processing proceeds to step 16.

In step 16, the image combination section 27 determines whether the hand color of the selected face image C is the "reversed display type." When it is determined that the hand color of the selected face image C is the "reversed display type" (S16; Yes), the image combination section 27 changes the display dots of the combined hand image Bc to the reversed display dots thereof (S17). Thus, the hands of the combined hand image Bc are represented by the reversed display dots. Next, the image combination section 27 performs the AND-combination (calculates AND) of the face image C and the combined hand image Bc in which the display dots are changed to the reversed display dots (S18). Thus, in the analog type clock image A, the rotation range F of the hands is represented by the display dots, and the hands are represented by the reversed display dots. That is, in the tape T, the rotation range F of the hands is represented by a color developed by heating the tape T, and the hands are represented by the natural color of the tape T. After the image combination section 27 performs the AND-combination, the processing proceeds to step 20.

On the other hand, when it is determined that the hand color of the selected face image C is not the "reversed display type" (S16; No), the image combination section 27 performs the OR-combination of the combined hand image Bc and the face image C (S19). Thus, in the analog type clock image A, the rotation range F of the hands is represented by the reversed display dots, and the hands are represented by the display dots. That is, in the tape T, the rotation range F of the hands is represented by the natural color of the tape T, and the hands are represented by the color developed by heating the tape T. After the image combination section 27 performs the OR-combination, the processing proceeds to step 20.

In step 20, the tape printer 1 performs print processing based on the generated analog type clock image A. Thus, the analog type clock image A is printed on the tape T. After the print processing, the tape printer 1 completes the series of processing.

A description will be given, with reference to FIGS. 9 and 10 and by the use of FIGS. 11A to 11H and FIGS. 12A to 12E, in further detail of the series of processing performed by the tape printer 1 according to the clock image print menu. Here, a description will be given, as an example, of the case of generating the analog type clock image A constituted by the face image C that appears in No. 7 and the short hand image B1 and the long hand image B2, each of which displays the time 03:00.

Figures 11A, 11B, 11C, 11D, 11E, 11F, 11G, 11H:
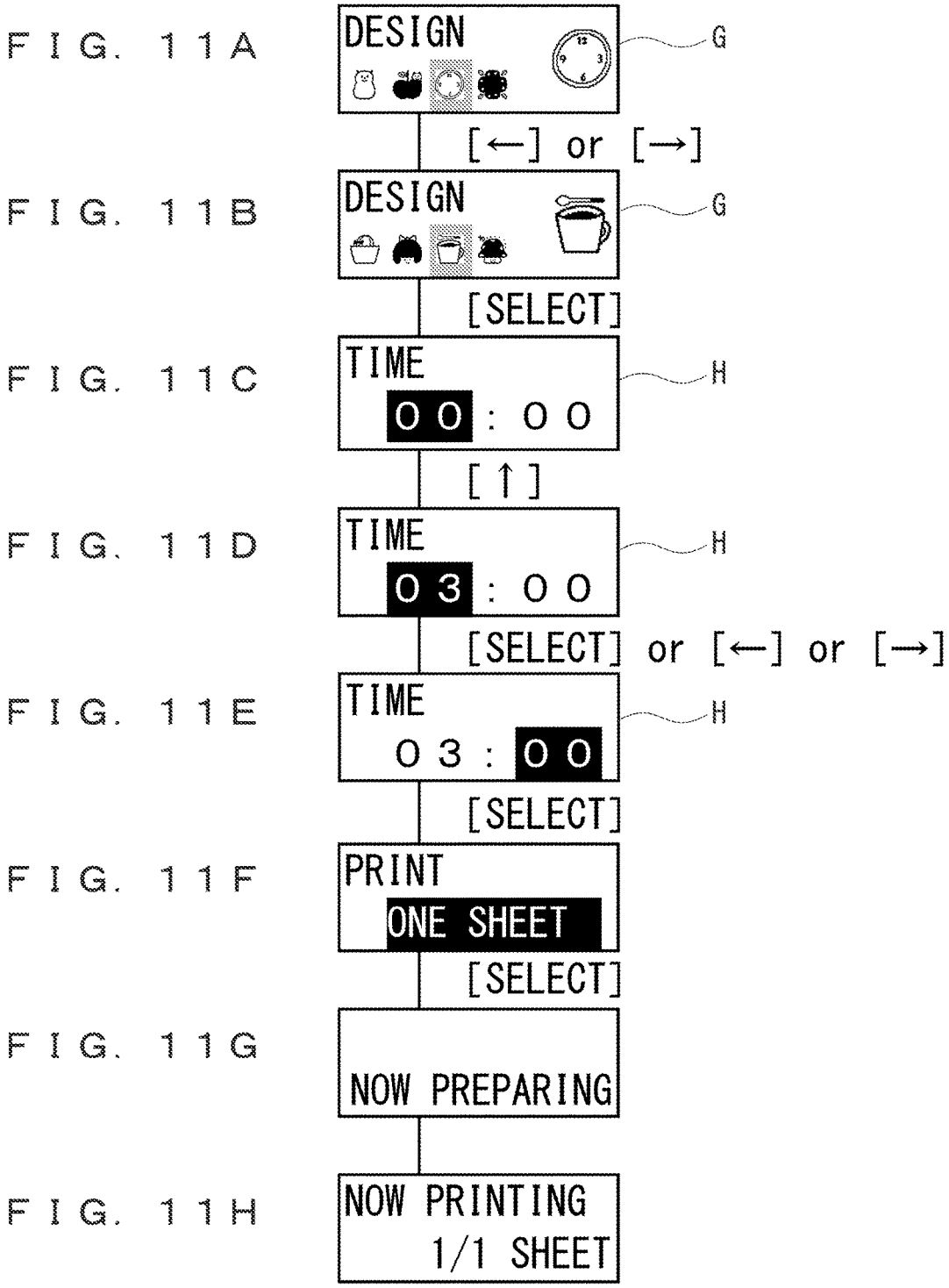
FIGS. 11A to 11H are diagrams showing the screen transition of the clock image print menu.

As shown in FIG. 11A, the tape printer 1 first displays the face image selection screen G on the display 9 when the clock image print menu starts (S1). Here, as shown in FIG. 11B, the user selects the face image C that appears in No. 7. When the face image C is selected by the user (S2; Yes), the tape printer 1 displays the time input screen H on the display 9 as shown in FIG. 11C (S3). At this time, the most recent setting value, i.e., the time input in the last time is displayed on the time input screen H (the default is 00:00). As shown in FIGS. 11D and 11E, the user inputs 03:00 as the time displayed by the short hand image B1 and the long hand image B2. When the time is input by the user (S4; Yes), the tape printer 1 displays a screen to select a print number on the display 9 as shown in FIG. 11F. When the print number is selected by the user, the tape printer 1 starts the generation processing of the analog type clock image A while displaying the sign "now preparing" on the display 9 as shown in FIG. 11G.

Figures 12A, 12B, 12C, 12D, 12E:
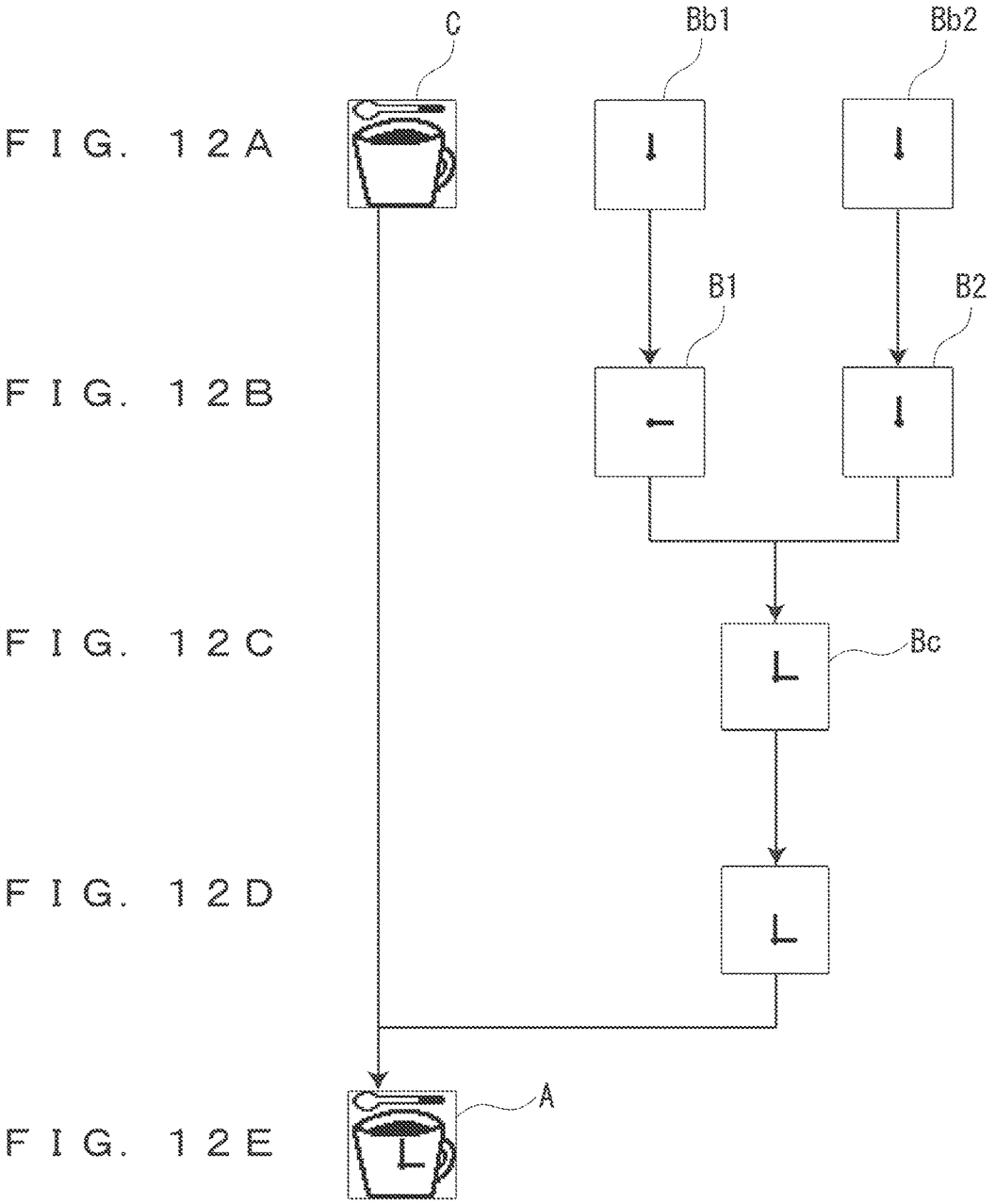
FIGS. 12A to 12E are diagrams for describing the generation processing of a hand type clock image.

In the generation processing of the analog type clock image A, the image read section 25 first reads the selected face image C that appears in No. 7 from the face image storage section 22 as shown in FIG. 12A (S5). In addition, the image read section 25 reads the basic short hand image Bb1 that has a hand angle of zero degree and has the straight line and the basic long hand image Bb2 that has a hand angle of zero degree and has the straight line from the hand image storage section 21 (S6). That is, since the acquired time points at 03:00, p=0 is obtained according to the above Formula 1. Therefore, the image read section 25 reads the basic short hand image Bb1 that has a hand angle of zero degree. In addition, q=0 is obtained according to the above Formula 2. Therefore, the image read section 25 reads the basic long hand image Bb2 that has a hand angle of zero degree.

Next, since the acquired time points at 03:00, the vertical/horizontal conversion section 26 determines that there is need to apply the vertical/horizontal conversion processing to the basic short hand image Bb1 (S7; Yes). As shown in FIG. 12B, the vertical/horizontal conversion section 26 applies the vertical/horizontal conversion processing (S8) to the short hand image Bb1 that has a hand angle of zero degree three times to rotate the same counterclockwise by 270 degrees to generate the short hand image B1 that displays 03:00. Then, since the minute of the acquired time points at zero minute, the vertical/horizontal conversion processing determines that there is no need to apply the vertical/horizontal conversion processing to the basic long hand image Bb2 (S10; No). Therefore, the basic long hand image Bb2 that has a hand angle of zero degree is directly used as the long hand image B2 that displays zero minute.

Next, as shown in FIG. 12C, the image combination section 27 performs the OR-combination of the short hand image B1 and the long hand image B2 to generate the combined hand image Bc (S13). Then, since the selected face image C is the one that appears in No. 7, the image combination section 27 determines that the hand position of the face image C is the "low type" (S14; Yes). As shown in FIG. 12D, the image combination section 27 shifts the combined hand image Bc downward by a prescribed distance (S15). Next, since the selected face image C is the one that appears in No. 7, the image combination section 27 determines that the hand color of the face image C is not the "reversed display type" (S16; No). As shown in FIG. 12E, the image combination section 27 performs the OR-combination of the combined hand image Bc shifted as described above and the face image C with each other to generate the analog type clock image A (S19).

When the generation processing of the analog type clock image A is completed, the tape printer 1 performs the print processing to print the generated analog type clock image A on the tape T while displaying the sign "now printing" on the display 9 as shown in FIG. 11H.

As described above, the tape printer 1 of the embodiment stores only the 15 types of the basic long hand images Bb2 among the 60 types of the long hand images B2 whose angles are different from each other. Further, the tape printer 1 rotates the basic long hand images Bb2 with the vertical/horizontal conversion section 26 used to switch the vertical direction E of the character images D between the horizontal writing direction and the vertical writing direction. In this way, the tape printer 1 may generate the long hand images B2 whose angles are different from those of the basic long hand images Bb2. The same applies to the short hand images B1. Accordingly, the tape printer 1 may reduce the storage capacity of the hand image storage section 21 without a dedicated image processing section to rotate the short hand images B1 and the long hand images B2.

The tape printer 1 of the embodiment may print the analog type clock image A, in which the face image C selected from among the ten types of the face images C, the short hand image B1, and the long hand image B2 are combined with each other, on the tape T.

The tape printer 1 of the embodiment stores only the basic hand images Bb whose hands are represented by the display dots among the basic hand images Bb whose hands are represented by the display dots and the basic hand images Bb whose hands are represented by the reversed display dots. Further, the tape printer 1 may print the analog type clock image A whose hands are represented by the reversed display dots and the analog type clock image A whose hands are represented by the display dots based on whether the rotation range F of the hands of the selected face image C is represented by the display dots or the reversed display dots. Accordingly, the tape printer 1 may increase the variations of the combination between the colors of the hands and the colors of the rotation ranges F of the hands while reducing the storage capacity of the hand image storage section 21.

The tape printer 1 of the embodiment stores only the basic hand images Bb in which the rotation center of the hands is provided at the center of the face image C. Further, the tape printer 1 may print the analog type clock image A in which the rotation center of the hands is provided at the center and the analog type clock image A in which the rotation center of the hands is shifted from the center based on whether the rotation range F of the hands of the selected face image C is positioned at the center or a position shifted downward from the center. Accordingly, the tape printer 1 may increase the variations of the rotation centers of the hands and the positions of the rotation ranges F of the hands while reducing the storage capacity of the hand image storage section 21.

The tape printer 1 of the embodiment may print the analog type clock image A that represents both the action plan of the user and the time of the action plan. Thus, the user may recognize both his/her action plan and the time of the action plan only by taking a glance at the analog type clock image A. For example, the user may recognize that he/he will have teatime at 03:00 only by taking a glance at the analog type clock image A shown in FIG. 12E.

Note that the present invention is not limited to the embodiment described above but may have various other configurations without departing from the spirit thereof.

For example, the embodiment may be modified as follows.

The vertical/horizontal conversion section 26 may rotate the character images D clockwise by 90 degrees to perform the vertical/horizontal processing. For example, the vertical/horizontal conversion section 26 may rotate, as the vertical/horizontal conversion processing, the character images D clockwise by 90 degrees three times instead of rotating the character images D counterclockwise by 90 degrees once.

The ranges of the hand angles of the basic hand images Bb stored in the hand image storage section 21 are arbitrarily, and the hand image storage section 21 may store the basic hand images Bb whose hand angles are, for example, between 90 and 176 degrees. In addition, the ranges of the hand angles are not necessarily continuous, and the hand image storage section 21 may store, for example, the basic hand images Bb whose hand angles are between zero and 30 degrees and the basic hand images Bb whose hand angles are between 126 and 176 degrees.

The intervals between the hand angles of the basic hand images Bb stored in the hand image storage section 21 are arbitrarily. For example, the hand image storage section 21 may store 30 types of the basic hand images Bb whose hand angles are different from each other by three degrees or may store five types of the basic hand images Bb whose hand angles are different from each other by 18 degrees.

The hand image storage section 21 may store, in the hand image storage section 21, only the basic hand images Bb whose hands are represented by white dots among the basic hand images Bb whose hands are represented by the display dots and the basic hand images Bb whose hands are represented by the reversed display dots. In this case, for example, when the rotation range F of the hands of the selected face image C is represented by the display dots, the image combination section 27 performs the AND-combination of the combined hand image Bc and the face image C. Thus, in the analog type clock image A, the rotation range F of the hands is represented by the display dots, and the hands are represented by the reversed display dots. On the other hand, when the rotation range F of the hands of the selected face image C is represented by the reversed display dots, the image combination section 27 performs the OR-combination of the face image C and the combined hand image Bc in which the display dots are changed to the reversed display dots. Thus, in the analog type clock image A, the rotation range F of the hands is represented by the reversed display dots, and the hands are represented by the display dots.

The hand image storage section 21 may store the basic hand images Bb in which the rotation center of the hands is provided at a prescribed position other than the center of the face image. In addition, the face image storage section 22 may store, for example, the face images C in which the rotation range F of the hands is shifted upward from a prescribed position and the face images C in which the rotation range F of the hands is shifted leftward from the prescribed position, besides the face images C in which the rotation range F of the hands is shifted downward from the prescribed position.

The time acquisition section 23 may cause time, which is displayed by the short hand image B1 and the long hand image B2, to be input on the time input screen H based on a 24-hour mode. In this case, for example, it is preferable that the face image C (that appears in No. 11) obtained by replacing the clock numbers "3, 6, 9, and 12" of the face image C that appears in No. 1 with the numbers "15, 18, 21, and 24" is stored in the face image storage section 22 and the face image selection section 24 selects one of the face image C that appears in No. 1 and the face image C that appears in No. 11 according to time input by the user. Thus, the analog type clock image A that shows morning or afternoon hours may be generated.

The time acquisition section 23 may acquire time, which is displayed by the short hand image B1 and the long hand image B2, from a timer installed in the tape printer 1, external equipment connected thereto so as to be communicatable, or received standard frequency transmission.

The tape printer 1 may print the analog type clock image A that has only one of the short hand image B1 and the long hand image B2. In addition, the tape printer 1 may print the analog type clock image A that does not have the face image C or may print the analog type clock image A that includes other images.

What is claimed is:

1. A tape printer comprising:

a vertical/horizontal conversion section that performs vertical/horizontal conversion processing to rotate a character image in at least one of a clockwise direction and a counterclockwise direction such that a direction of the character image printed on a tape is switched between a horizontal writing direction in which a vertical direction of the character image is parallel to a width direction of the tape and a vertical writing direction in which the vertical direction of the character image is parallel to a longitudinal direction of the tape;

a print section that prints the character image on the tape;

a time acquisition section that acquires time displayed by a hand image constituting a hand type clock image serving as the character image; and a basic hand image storage section that stores a main basic hand image before being subjected to the vertical/horizontal conversion processing, the main basic hand image included in a plurality of the hand images whose angles are different from each other according to time, wherein when the hand image that displays the time acquired by the time acquisition section is not included in the basic hand image, the vertical/horizontal conversion section performs the vertical/horizontal conversion processing on the basic hand image stored in the basic hand image storage section to generate the hand image that displays the time acquired by the time acquisition section.

2. The tape printer according to claim 1, further comprising:

a face image storage section that stores a plurality of face images, one of which constitutes the hand type clock image;

a face image selection section that selects one of the face images to be printed with the hand image; and an image combination section that combines the selected face image and the hand image with each other to generate the hand type clock image.

3. The tape printer according to claim 2, wherein the hand image storage section stores one of the basic hand image whose hand is represented by display dots and the basic hand image whose hand is represented by reversed display dots obtained by reversing the display dots, the face image storage section stores the face images in which a rotation range of the hand is represented by display dots and the face images in which a rotation range of the hand is represented by reversed display dots, and the image combination section combines the face image and the hand image with each other such that the hand of the hand type clock image is represented by the reversed display dots when the rotation range of the hand of the selected face image is represented by the display dots, and combines the face image and the hand image with each other such that the hand of the hand type clock image is represented by the display dots when the rotation range of the hand of the selected face image is represented by the reversed display dots.

4. The tape printer according to claim 2, wherein the hand image storage section stores the basic hand image in which a rotation center of a hand is provided at a prescribed position, the face image storage section stores the face images in which a rotation range of the hand is set at the prescribed position and the face images in which a rotation range of the hand is set at a position shifted from the prescribed position, and the image combination section shifts the hand image and combines the face image and the shifted hand image with each other when the rotation range of the selected face image is set at a position shifted from a position corresponding to the prescribed position.

5. The tape printer according to claim 2, wherein the plurality of face images stored in the face image storage section includes the face images representing action plans of a user.

* * * * *